US005377370A

United States Patent [19]

Foster et al.

[11] Patent Number: 5,377,370

[45] Date of Patent: Jan. 3, 1995

[54] HOSPITAL BED WITH COLLAPSING WING

[75] Inventors: L. Dale Foster; Ryan A. Reeder, both of Brookville, Ind.

[73] Assignee: Hill-Rom Company, Inc., Batesville, Ind.

[21] Appl. No.: 74,925

[22] Filed: Jun. 10, 1993

[51] Int. Cl.[6] ..... A47G 7/02; A61G 7/015

[52] U.S. Cl. ..... 5/620; 5/600; 5/185

[58] Field of Search ..... 5/600, 613, 620, 602, 5/181, 185

[56] References Cited

U.S. PATENT DOCUMENTS

| | | | |
|---|---|---|---|
| 2,284,470 | 5/1942 | Comper et al. . | |
| 2,786,214 | 3/1957 | Armstrong . | |
| 3,585,660 | 6/1971 | Gottfried et al. | 5/430 |
| 3,930,273 | 1/1976 | Stern | 5/100 |
| 3,958,283 | 5/1976 | Adams et al. . | |
| 4,002,330 | 1/1977 | Johansson . | |
| 4,206,525 | 6/1980 | Williams | 5/430 |
| 4,234,982 | 11/1980 | Bez et al. | 5/424 |
| 4,486,908 | 12/1984 | Schroeder | 5/430 |
| 4,612,679 | 9/1986 | Mitchell | 5/425 |
| 4,653,129 | 3/1987 | Kuck et al. | 5/430 |
| 4,669,136 | 6/1987 | Waters et al. | 5/181 |
| 4,747,171 | 5/1988 | Einsele et al. | 5/425 |
| 4,894,876 | 1/1990 | Fenwick | 5/602 |
| 4,967,431 | 11/1990 | Hargest et al. | 5/453 |
| 4,985,946 | 1/1991 | Foster et al. | 5/430 |
| 4,987,623 | 1/1991 | Stryker et al. | 5/185 |
| 5,023,967 | 6/1991 | Ferrand | 5/185 |
| 5,054,141 | 10/1991 | Foster et al. | 5/81.1 |
| 5,077,843 | 1/1992 | Foster et al. | 5/185 |
| 5,083,332 | 1/1992 | Foster et al. | 5/185 |
| 5,179,744 | 1/1993 | Foster et al. | 5/600 |

FOREIGN PATENT DOCUMENTS

| | | |
|---|---|---|
| 141382 | 7/1921 | United Kingdom . |
| 189572 | 12/1922 | United Kingdom . |

*Primary Examiner*—Alexander Grosz
*Attorney, Agent, or Firm*—Wood, Herron & Evans

[57] ABSTRACT

A collapsing wing on a lateral side near the head end of a hospital bed. As the result of a laterally inwardly applied force, the wing collapses thereby allowing easier access to the center or furthermost side of the hospital bed or patient for a nurse or care provider. The wing is attached to the bed frame of the hospital bed by a spring loaded parallelogram linkage which permits the wing to move laterally within a generally horizontal plane as a result of the inward force. Once the inward force is removed, the linkage returns the wing to the full width hospital bed configuration. The wing is a U-shaped channel open toward the bed. The bed has a narrower U-shaped channel open toward the wing channel. The channels are connected by the parallelogram linkage. The wing channel nests over the frame channel when a laterally inward force is applied to the wing channel.

14 Claims, 2 Drawing Sheets

HOSPITAL BED WITH COLLAPSING WING

FIELD OF THE INVENTION

This invention relates to hospital beds, and more particularly, to a hospital bed which can be converted from a full width hospital bed to a narrow width hospital bed permitting a care provider better access to the centermost or furthermost portion of the bed.

BACKGROUND OF THE INVENTION

Hospital beds are used in critical care rooms which are designed to provide patients with many services such as oxygen, vacuum, vital signs monitors, and other services. The critical care rooms have these services so the care providers and nurses may correctly apply the available patient care instruments as needed.

A typical hospital bed is about 42 inches in width and the nurse must physically reach, touch, and manipulate the patient in order to perform the required health care treatment. Even with the most efficient health care equipment, the nurse is required to take many steps in the patient's room to perform these many necessary services. The nurse must access the patient within the centermost portion of the bed and the nearest edge of the bed and then walk to the opposite side of the hospital bed in order to have access to the furthermost side of the bed or patient. Furthermore, the hospital bed within a critical care room is frequently aligned on one lateral side of the bed with the required health care equipment, thereby inhibiting access to the patient on that side of the bed and requiring the care provider to awkwardly and inconveniently reach over the patient to gain access from one side of the bed to the opposite side.

A typical hospital bed is so wide that the nurse or care provider cannot conveniently reach both sides of the patient or cannot reach equipment located on the opposite side of the bed from which the nurse stands. The hospital bed has a patient support surface mounted on a base, and the patient support surface includes a mattress that is usually between 34 and 36 inches wide. Side guards are added to the bed so that the overall width dimension of the hospital bed is about 42 inches. A care provider who is 5'2" could reach across about 25 to 30 inches of the 36 inch bed. Thus, the nurse cannot reach equipment that is located on the opposite side of the bed from the nurse and cannot conveniently reach the extremities of the patient to which health care administration equipment may be connected.

Prior solutions to the above-mentioned problems are shown in U.S. Pat. Nos. 5,083,332; 5,077,843; 5,054,141; and 4,985,946, each assigned to the assignee of the present invention. U.S. Pat. No. 5,083,332 discloses a full size hospital bed convertible to a stretcher width bed when an inflatable mattress tube on each side of the bed is deflated. An air transfer system is provided for inflating the mattress tubes. U.S. Pat. No. 5,077,843 also discloses a hospital bed with collapsible side sections on each side of the bed. The collapsible side sections consist of inflatable mattress sections mounted on wings that can swing from a horizontal position to a vertical position. The inflatable sections are connected to a compressor for quick inflation.

U.S. Pat. Nos. 5,054,141 and 4,985,946 are each directed to a hospital bed with longitudinal side sections that are removable by pivoting them upward thereby collapsing the mattress portion overlying the side section. Alternatively, the side sections can be physically removed and placed at the head end of the bed thereby narrowing the width of the hospital bed.

SUMMARY OF THE INVENTION

It has been an objective of this invention to improve upon the prior described devices in providing a full width hospital bed which can be selectively collapsed on a lateral edge in order to provide ready access to the centermost or the furthermost portion of the bed.

In accordance with the present invention, the problem of reach is solved by providing collapsible wings on each side of the bed. These wings collapse as a result of a lateral force applied to them and provide about an additional five inches of reach on each side of the bed. This permits the nurse to move closer on one side or bring equipment closer on the other side of the bed, thereby shortening the reach problem by approximately ten inches.

In the preferred embodiment of the invention, it is possible to selectively collapse a wing section on either or both sides of the bed. The wings are located at the head end of the bed on each side thereof and are approximately four to six inches wide by three feet long. The portion of the mattress overlying the wing section is deformable to allow a care provider to lean against the collapsible wing so as to gain better access to the center or furthermost portion of the bed.

The wing section Of the present invention consists of a U-shaped channel open toward and connected to the frame of the hospital bed. A U-shaped channel is also provided on the frame of the bed open toward the wing channel. The bed frame channel is narrower than the wing channel so that when a lateral force is applied to the wing channel, the wing channel moves inwardly with the bed frame channel nesting within the collapsing wing channel.

The wing section of the present invention consists of channel by a parallelogram linkage consisting of three generally parallel links in the preferred embodiment of the present invention. Each link is pinned or pivotally connected on one end to the wing channel and on an opposite end to the frame channel. A torsion spring is located at the connection of each link and the wing channel. The torsion spring applies outwardly directed force to the wing channel in order to maintain the wing channel in spaced relation with the hospital bed until such time as an external force is applied laterally inwardly to the wing channel. The laterally inward force collapses the wing channel to nest over the frame channel and deflects the torsion spring. Once the lateral force is removed, the torsion spring returns to its undeflected state thereby returning the wing channel to its spaced relationship with the bed frame. In the preferred embodiment of the present invention, a detent is provided for each link to inhibit the torsion spring from expanding the wing channel beyond the width of the standard hospital bed configuration.

BRIEF DESCRIPTION OF THE DRAWINGS

The several features and objectives of the present invention will become more readily apparent from the following detailed description taken in conjunction with the accompanying drawings in which.

DETAILED DESCRIPTION OF THE INVENTION

Figures 1, 2:
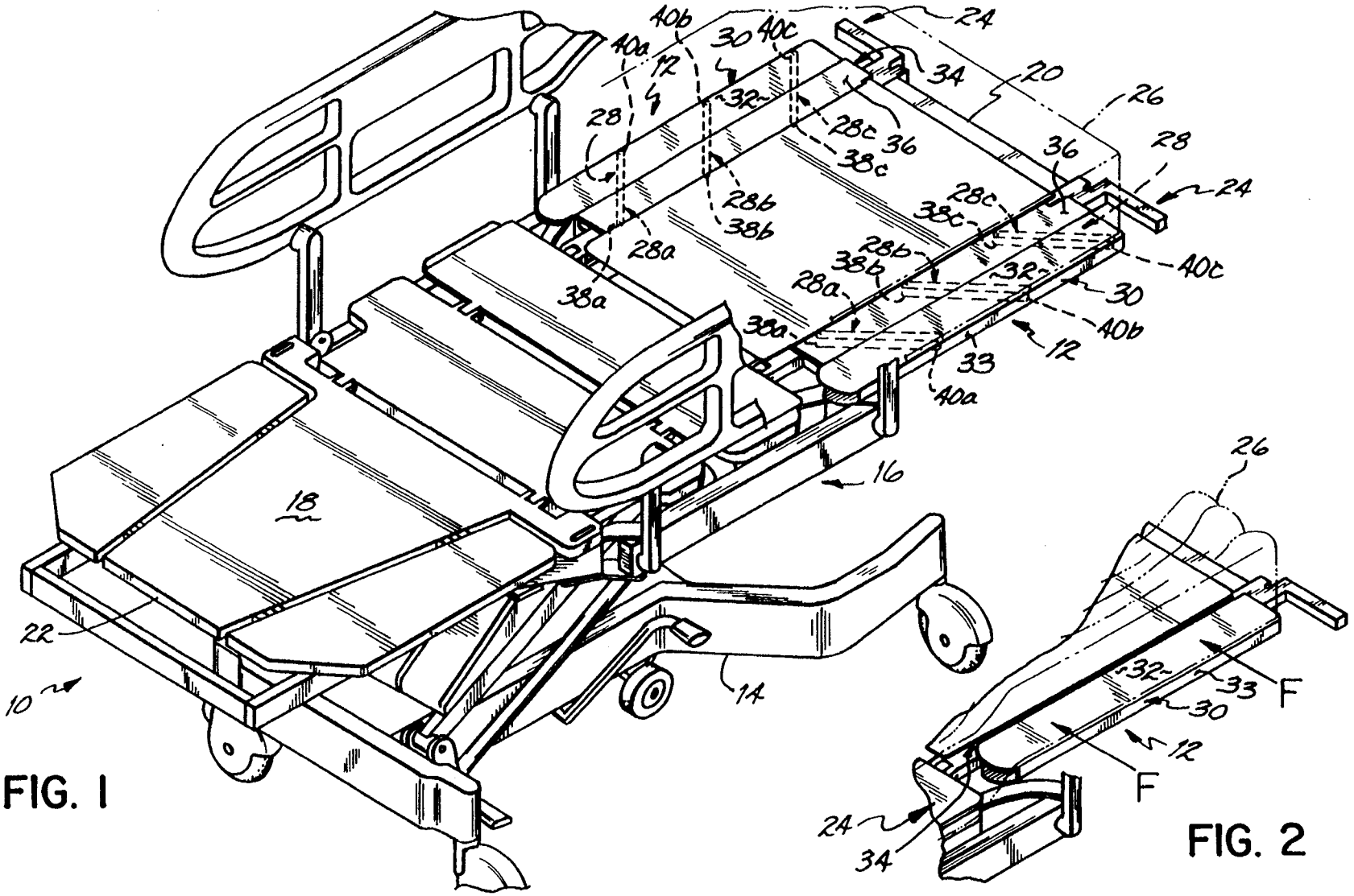
FIG. 1 is a diagrammatic perspective view of the hospital bed of the present invention with the mattress shown partially in phantom.
FIG. 2 is a partial diagrammatic perspective view of the hospital bed of FIG. 1 with a lateral inward force being applied to show the collapsing wing of the present invention and deformation of the mattress shown in phantom.

Referring to FIG. 1, a hospital bed 10 with a pair of collapsing wings 12, 12 is shown as having a base 14 including a bed frame 16 mounted above the base 14 and a patient support surface 18 mounted on the frame 16. The frame 16 has a head end 20 opposite a foot end 22 with lateral sides 24, 24 extending therebetween. The patient support surface 18 underlies a mattress 26 shown in phantom in FIG. 1. Collapsing wings 12, 12 are provided on the hospital bed 10 according to the present invention near the head end 20 of the frame on each lateral side 24 of the bed. The wings 12 contribute to support of the mattress 26 provided on the hospital bed 10.

Figure 3:
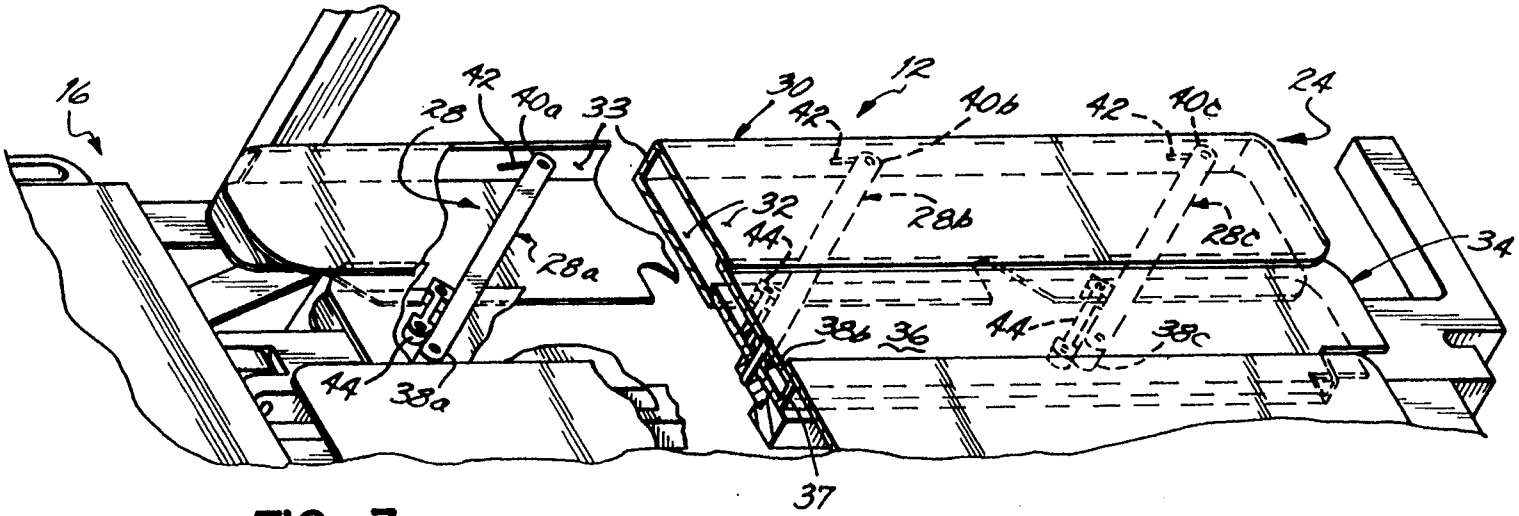
FIG. 3 is a diagrammatic perspective view of the collapsing wing in spaced relation to the hospital bed frame of the present invention.
Figure 4:
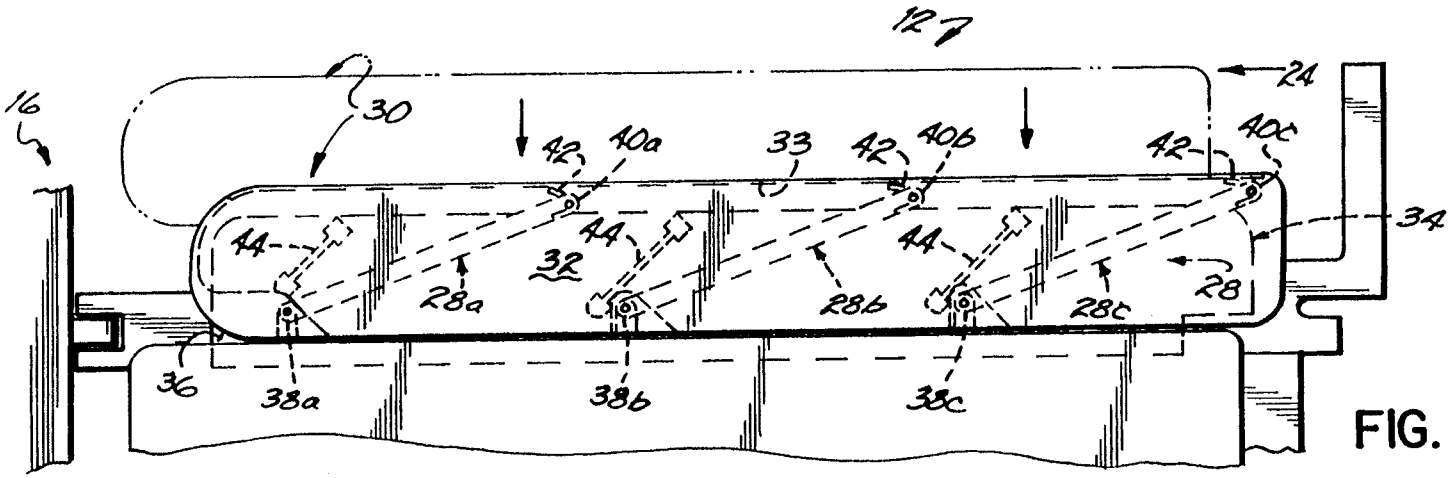
FIG. 4 is a diagrammatic plan view of a wing of the present invention collapsed as a result of an inward lateral force applied thereto.

Each of the wings 12, 12 according to the present invention is attached to the bed frame 16 by a parallelogram linkage 28 consisting of three links 28*a–c* shown in FIGS. 1, 3, and 4 of the preferred embodiment of the present invention. The links 28*a–c* enable the wing 12 to move laterally in a generally horizontal plane defined by the bed frame 16. Once a laterally inward force F is applied, the wing 12 translates inwardly toward the bed frame 16, and the mattress 26 positioned thereon deforms as shown in FIG. 2. As a result of the inwardly directed force F applied to the lateral side of the bed frame, a standard width hospital bed is contracted to a narrow width hospital bed configuration until such time as the lateral force F is removed.

The collapsing wing 12 of the hospital bed 10 of the present invention consists of a wing channel 30 having a pair of spaced wing channel side walls 32, 32 connected by a wing channel bight 33 as shown in FIG. 3. The wing channel 30 is open inwardly towards the bed frame 16. The bed frame 16 has a bed frame channel 34 secured thereto which has a pair of frame channel side walls 36, 36 connected by a frame channel bight 37 opened outwardly towards the wing channel 30. The wing channel side walls 32, 32 provide an opening of sufficient width to allow the frame channel 34 to nest within the wing channel 30 when the wing 12 collapses inwardly.

The links 28*a–c* which connect the wing channel 30 to the frame channel 34 are pivotally attached between the wing channel side walls 32, 32 on a first respective link end 40*a–c* of each link 28*a–c* and the frame channel side walls 36, 36 on the respective opposite end 38*a–c* of each link 28*a–c*. Absent the lateral inward force, the wing 12 is maintained at a spaced relationship relative to the bed frame 16 as shown in FIG. 3 by a torsion spring 42 attached to the pivot connection of each respective link end 40 with the wing channel 30. The links 28*a–c* are limited in their range of rotation as a result of the tension provided by the torsion spring 42 by a detent bar 44 secured within the frame channel 34 provided for each link, thereby defining the limit the wing channel 30 can be spaced away from the bed frame 16.

As the lateral inward force F is applied to the wing channel 30, links 28*a–c* pivot, thereby collapsing the wing 12 towards the bed frame 16 as shown in FIG. 4. As the wing 12 collapses, the wing channel side walls 32, 32 slide over the frame channel side walls 36, 36, thereby nesting the wing channel 30 over the frame channel 34. The wing 12 collapses inwardly as a result of the lateral force F to the extent the channel side walls 32, 32 contact the bed frame 16, thereby inhibiting further collapse of the wing 12 and defining a narrow bed width configuration.

As the inward force F is applied to the wing 12, the torsion springs 42 provided between each link end 38*a–c* and the wing channel 30 are exposed increased tension. Once the lateral force F is removed, each link 28*a–c* pivots as a result of its torsion spring 42 until the respective link 28*a–c* contacts its detent bar 44, thereby returning the wing 12 to the spaced relationship with the bed frame 16 and the full bed width configuration. The torsion spring 42 operates to expand wing 12 away from the bed frame 16 once the inwardly directed force F is removed.

From the above disclosure of the general principle of the present invention and the preceding detailed description of a preferred embodiment, those skilled in the art will readily comprehend the various modifications to which the present invention is susceptible. Therefore, we desire to be limited only by the scope of the following claims and equivalents thereof:

What is claimed is:

1. A hospital bed comprising:

a base;

a bed frame mounted above said base, said frame having spaced lateral sides and a head end spaced from a foot end;

a wing on at least one lateral side of said frame proximate said head end; and linkage means having a first end pivotably connected to said frame, and a second end pivotally connected to said wing, said linkage means connecting said wing to said frame permitting said wing to be selectively moved laterally in a plane generally defined by said frame, said linkage means being operable to adjust the lateral position of said wing and thereby a lateral dimension of the bed.

2. The hospital bed of claim 1 wherein said linkage means is a parallelogram linkage which comprises a plurality of spaced generally parallel links, each said link being pivotally connected to said frame at a first link end and being pivotally connected to said wing at a second link end.

3. The hospital bed of claim 1 further comprising:

resilient means for maintaining said wing in a laterally spaced relation with respect to said frame when no lateral force is applied to said wing thereby defining a full width hospital bed configuration, said resilient means permitting said wing to move laterally inwardly toward said frame when a lateral force is applied to said wing thereby defining a narrow width hospital bed configuration, said resilient means returning said wing to said laterally spaced relation with respect to said frame upon removing the lateral force from said wing thereby returning said bed to said full width hospital bed configuration.

4. The hospital bed of claim 3 wherein said resilient means comprises a torsion spring means connected to said linkage means and being operable between said linkage means and said wing.

5. The hospital bed of claim 1 wherein said wing comprises a U-shaped channel having a pair of channel side walls, said wing channel defining an opening facing toward said frame, and wherein said frame includes a U-shaped channel secured thereto defining an opening facing toward said wing channel, said frame channel adapted to nest between said wing channel side walls when said wing channel is moved laterally inwardly.

6. The hospital bed of claim 5 wherein said linkage means is connected between said wing channel and said frame channel.

7. A hospital bed comprising:

a base;

a bed frame mounted above said base, said frame having spaced lateral sides and a head end spaced from a foot end;

a wing in the form of an inwardly facing U-shaped channel on at least one lateral side of said frame proximate said head end, said wing channel having a pair of wing channel side walls;

a linkage connecting said wing channel to an outwardly facing U-shaped channel mounted on said frame, said frame channel having a pair of frame channel side walls, said linkage being operable to allow said wing channel to be selectively moved laterally in a plane generally defined by said frame, said linkage comprising a plurality of spaced generally parallel links, each said link being pivotally connected to said frame channel side walls at a first link end and being pivotally connected to said wing channel side walls at a second link end; and at least one torsion spring operably connected between at least one of said second link ends and said wing channel, said torsion spring being operable to permit said wing to move laterally inwardly toward said frame when a lateral force is applied to said wing thereby defining a narrow width hospital bed configuration, and being operable to return said wing to a laterally spaced relation with respect to said frame when the lateral force is removed from the wing thereby returning said bed to a full width hospital bed configuration.

8. A wing adapted for use with a hospital bed comprising:

a U-shaped wing channel having a pair of channel side walls which define an opening, said wing channel to be positioned on the lateral edge of a hospital bed, said wing channel opening facing inwardly toward the bed: and linkage means connecting said wing channel to the hospital bed permitting said wing channel to be selectively moved laterally in a plane generally defined by the hospital bed, said linkage means being operable to adjust the lateral position of said wing channel and thereby a lateral dimension of the hospital bed.

9. The wing of claim 8 wherein said linkage means is a parallelogram linkage which comprises a plurality of spaced generally parallel links, each link being pivotally connected to the hospital bed at a first link end and being pivotally connected to said wing channel at a second link end.

10. The wing of claim 8 further comprising:

resilient means for maintaining said wing channel in a laterally spaced relation with respect to the hospital bed when no lateral force is applied to said wing channel thereby defining a full width hospital bed configuration, said resilient means permitting said wing channel to move laterally inwardly toward the hospital bed when a lateral force is applied to said wing channel thereby defining a narrow width hospital bed configuration, said resilient means returning said wing channel to said laterally spaced relation with respect to the hospital bed upon removing the lateral force from said wing channel thereby returning the hospital bed to the full width configuration.

11. The wing of claim 8 wherein said resilient means comprises torsion spring means connected to said linkage means and being operable between said linkage means and said channel wing.

12. The wing of claim 8 further including a co-operating U-shaped channel to be secured to the hospital bed defining an opening facing toward said wing channel, said frame channel nesting between said wing channel side walls when said wing channel is moved laterally inwardly.

13. The wing of claim 12 wherein said linkage means is connected between said wing channel and said frame channel.

14. A wing adapted for use with a hospital bed comprising:

a U-shaped wing channel having a pair of channel side walls defining an opening facing toward the hospital bed;

a U-shaped bed channel to be secured to a lateral edge of the hospital bed and defining an opening facing toward said wing channel, said bed channel having a pair of bed channel side walls;

a linkage connecting said wing channel to said bed channel, said linkage being operable to allow said wing channel to be selectively moved laterally in a plane generally defined by the hospital bed, said linkage comprising a plurality of spaced generally parallel links, each said link being pivotally connected to said bed channel side walls at a first link end and being pivotally connected to said wing channel side walls at a second link end; and at least one torsion spring operably connected between at least one of said second link ends and said wing channel, said torsion spring being operable to permit said wing to move laterally inwardly toward the hospital bed when a lateral force is applied to said wing thereby defining a narrow width hospital bed configuration, and being operable to return said wing to a laterally spaced relation with respect to the hospital bed when the lateral force is removed from the wing thereby returning the bed to a full width hospital bed configuration.

* * * * *